US006786369B2

(12) United States Patent
Garcia et al.

(10) Patent No.: US 6,786,369 B2
(45) Date of Patent: Sep. 7, 2004

(54) FLUID DISPENSER

(75) Inventors: Firmin Garcia, Evreux (FR); Alex Millian, Breuteuil sur Iton (FR); Fabienne Uguen, Le Val David (FR)

(73) Assignee: Valois SAS, Neubourg (FR)

( * ) Notice: Subject to any disclaimer, the term of this patent is extended or adjusted under 35 U.S.C. 154(b) by 0 days.

(21) Appl. No.: 10/396,510

(22) Filed: Mar. 26, 2003

(65) Prior Publication Data

US 2003/0183664 A1 Oct. 2, 2003

Related U.S. Application Data

(60) Provisional application No. 60/382,048, filed on May 22, 2002.

(30) Foreign Application Priority Data

Mar. 26, 2002 (FR) ..... 02 03923

(51) Int. Cl.[7] ..... B05B 11/06

(52) U.S. Cl. ..... 222/632; 222/633; 239/325; 239/327

(58) Field of Search ..... 222/631, 632, 222/633, 209; 239/325, 327, 654; B05B 11/06

(56) References Cited

U.S. PATENT DOCUMENTS

| | | | | | |
|---|---|---|---|---|---|
| 156,696 | A | * | 11/1874 | Fichtenberg | 222/633 |
| 337,943 | A | * | 3/1886 | Fonerdent et al. | 222/633 |
| 3,018,926 | A | * | 1/1962 | Gilstrap | 222/633 |
| 3,943,660 | A | * | 3/1976 | Hosaka | 222/631 |
| 4,941,599 | A | | 7/1990 | Reinertz et al. | |
| 5,215,221 | A | * | 6/1993 | Dirksing | 222/633 |
| 5,803,311 | A | * | 9/1998 | Fuchs | 222/212 |

FOREIGN PATENT DOCUMENTS

| | | | |
|---|---|---|---|
| CH | 518744 | 2/1972 | |
| CH | 532513 | 1/1973 | |
| DE | 94949 | 9/1897 | |
| FR | 2038476 | 8/1971 | |
| FR | 2780388 | 12/1999 | |
| WO | WO 9007351 A * | 7/1990 | A61M/13/00 |

* cited by examiner

*Primary Examiner*—Kenneth Bomberg
(74) *Attorney, Agent, or Firm*—Sughrue Mion, PLLC

(57) ABSTRACT

A fluid dispenser including: an entraining gas reservoir (10) provided with an actuator (12') suitable for pressurizing the gas contained in the reservoir; a fluid reservoir (3); and a dispensing orifice (21) serving to pass a mixture made up of entraining gas and of fluid; the fluid reservoir (3) being separated from the gas reservoir (10) by a partition (31"; 31"'). The partition is permeable to the gas and impermeable to the fluid, so that the pressurized gas penetrates into the fluid reservoir (3) through the partition, and entrains the fluid with it towards the dispensing orifice. The fluid is urged towards the dispensing orifice by thrust mechanism (32", 32"') so that fluid is always present at the dispensing orifice.

9 Claims, 4 Drawing Sheets

FLUID DISPENSER

CROSS REFERENCE TO RELATED APPLICATION

This application claims the benefit under 35 U.S.C. §119 (e) of pending U.S. provisional patent application Serial No. 60/382,048, filed May 22, 2002, and priority under 35 U.S.C. §119(a)–(d) of French patent application No. FR-02.03923, filed Mar. 26, 2002.

TECHNICAL FIELD

The present invention relates to a fluid dispenser comprising an entraining gas reservoir provided with actuating means suitable for pressurizing the gas contained in the reservoir, a fluid reservoir, and a dispensing orifice serving to pass a mixture made up of entraining gas and of fluid. The entraining gas reservoir thus serves as an air flush to entrain the contents of the fluid reservoir towards the dispensing orifice so as to be dispensed there in the form of a two-phase gas/liquid or gas/powder mixture.

BACKGROUND OF THE INVENTION

Numerous fluid dispensers of this type already exist, in particular in the fields of perfumes, of cosmetics, or else and especially of pharmaceuticals. Very often, the fluid is stored in the same reservoir as the entraining gas. Sometimes, the fluid and the entraining gas are stored in separate reservoirs. It is then necessary for the entraining gas to be able to take away some or all of the contents of the fluid reservoir.

In the prior art, FR-2 038 476 describes a powder dispenser comprising a gas (air) reservoir having the shape of a bellows on which is mounted a cylindrical duct. The dispenser further comprises an end piece designed to be mounted on the free end of the duct. This end piece defines a powder reservoir sealed with a partition made of air permeable and powder impermeable porous material. The end piece also forms a dispensing orifice sealable with a cap. When the bellows is squeezed, air is pressurized and expelled through the partition so as to enter the powder reservoir, thus creating turbulences in the reservoir allowing the powder and air mixing to be expelled through the dispensing orifice.

The partition makes it possible not only to retain the fluid inside the fluid reservoir, but also to disperse the flow of gas coming from the entraining gas reservoir. The fluid is thus entrained better towards the dispensing orifice. The partition acts as a screen, grating, or lattice defining holes in which the fluid builds up so that the flow of pressurized gas passes through the holes and entrains the fluid with it. A grating, screen, or lattice structure is suitable for a fluid in powder form, while a porous structure is more suitable for a fluid in liquid form.

An object of the present invention is precisely to facilitate entraining of the fluid by the flow of entraining gas.

SUMMARY OF THE INVENTION

To this end, the present invention proposes a fluid dispenser comprising:

- an entraining gas reservoir provided with actuating means suitable for pressurizing the gas contained in the reservoir;
- a fluid reservoir; and
- a dispensing orifice serving to pass a mixture made up of entraining gas and of fluid;

- the fluid reservoir being separated from the gas reservoir by a partition, said partition being permeable to the gas and impermeable to the fluid, so that the pressurized gas penetrates into the fluid reservoir through the partition, and entrains the fluid with it towards the dispensing orifice, characterized in that the fluid is urged towards the dispensing orifice by thrust means so that fluid is always present at the dispensing orifice.

In an embodiment of the invention, the partition of the fluid reservoir is situated in a constriction formed by the entraining gas reservoir. For example, the gas reservoir comprises a body and a neck, the neck defining an opening that communicates with the inside of the body via a duct, the partition of the fluid reservoir being disposed in said duct at least in part. This is an embodiment that is very practical. Another feature of the invention is that an end-piece is in leaktight engagement with the neck of the gas reservoir, said end-piece forming the dispensing orifice. Advantageously, the fluid reservoir is formed in part by said end-piece.

In another embodiment, the fluid reservoir has a body in engagement with the end-piece, said body forming said partition. Advantageously, the end-piece forms a socket that is open towards the gas reservoir and that is closed in part at the dispensing orifice, the fluid reservoir forming a body engaged in said socket.

Another practical feature is that the fluid reservoir has a first end at which the dispensing orifice is formed, and a second end, said second end being impermeable to the fluid and to the gas. Advantageously, the body of the fluid reservoir comprises a tubular segment forming said partition, said tubular section being in engagement in the end-piece, said segment defining a first end adjacent to the dispensing orifice and a second end closed off by a closure member that is impermeable to the gas.

It is thus possible to obtain dispensing that is more reliable and more uniform, since the entraining gas is constrained to pass through the dispensing orifice, which is always fed with fluid. According to an embodiment, the fluid reservoir comprises a movable wall in a direction corresponding to a decreasing of the reservoir volume. Advantageously, the partition is mounted to move relative to and advantageously towards the dispensing orifice. Preferably, the partition is urged resiliently in the direction in which the internal volume of the fluid reservoir decreases. Advantageously, the partition forms a part of the movable wall. In a practical embodiment, the partition is mounted on a scraper piston which is slidably engaged in a cylinder. In a variant, the partition is mounted on a prestressed resilient membrane organized to return towards a rest position.

According to another embodiment, the wall is movable by the pressurized gas flow.

BRIEF DESCRIPTION OF THE DRAWINGS

The invention is described more fully below with reference to the accompanying drawings which give various embodiments of the invention by way of non-limiting example.

In the figures.

DETAILED DESCRIPTION OF THE PREFERRED EMBODIMENTS

Figure 1:
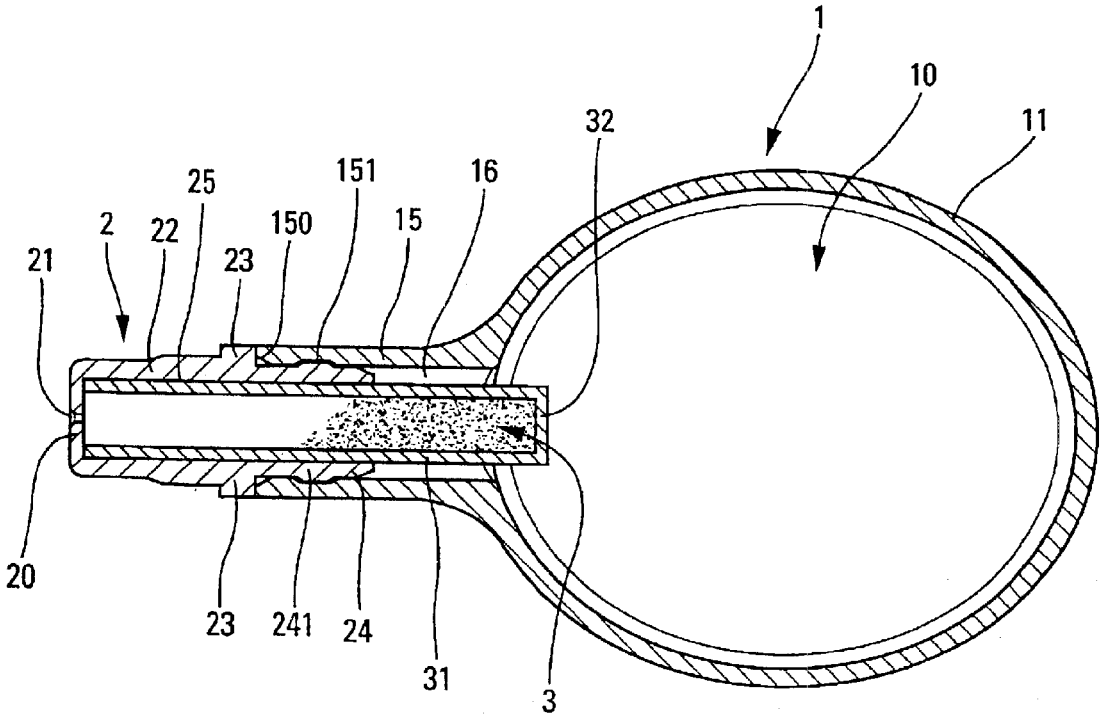
FIGS. 1 and 2 are section views seen respectively from above and in profile through a first embodiment of a fluid dispenser of the invention.

In the embodiments used to illustrate the present invention, the fluid dispenser comprises an entraining gas reservoir 10 formed by a receptacle 1 which is shown in FIGS. 1 to 4 in the form of a small flask or bottle that is substantially flat and that defines two substantially plane opposite faces 12 and 13 that are interconnected via a substantially circular peripheral edge 11. The flask 1 is further provided with a neck 15 defining an internal duct 16 via which the reservoir 10 communicates with the outside. The neck 15 is provided with an annular top edge 150 and with a recessed inside wall 151. The reservoir 10 serves to contain a gas, e.g. air. However, it is possible to imagine other types of gas as a function of the fluid that is to be dispensed.

This particular configuration of the reservoir 10 based on a flask 1 is not the only possible configuration: other shapes are possible for the entraining gas reservoir 10, as shown in FIGS. 5 to 8 which show a reservoir in the form of a squeezable bulb.

In FIGS. 1 to 4, one or preferably two plane faces 12 and 13 are substantially elastically deformable so that they can be brought together by pressing on them with two fingers, for example, so as to reduce the volume of the reservoir 10. Thus, the gas contained inside is pressurized, thereby causing it to be delivered through the duct 1 which forms a constriction, thereby accelerating the gas inside. The two arrows referenced P show the directions of the force to be applied to the actuating walls 12 and 13 of the reservoir 10. Naturally, it is possible to imagine other actuating means for reducing the volume of the reservoir 10, such as, for example, a piston mounted to move inside a cylinder forming the reservoir.

In all of the embodiments, the entraining gas is associated with a dispensing end-piece 2, 2', 2" which is mounted in the neck 15 of the flask 1. More precisely, the dispensing end-piece forms a fixing sleeve 24 which is engaged in leaktight manner in the neck 15. To enable the end-piece to be held properly, the sleeve 24 forms a projecting profile or fixing bead 241 serving to come to be received in the recess 151 formed in the inside wall of the neck 15. Above its sleeve 24, the end-piece forms an abutment collar 23 which projects radially inwards and which comes into abutting contact against the top end 150 of the neck 15. Above this collar 23, the end-piece 2 forms a drum 22, 22', 22", 22''' whose free end is closed off in part by a dispensing front end wall 20 provided with a through dispensing orifice 21. It is also possible to have a plurality of dispensing orifices 21. The dispensing end-piece internally forms a socket 25, 25' which extends inside the sleeve 24, inside the collar 23 and inside the drum. The socket 25 is wide open at the free end of the sleeve 24 and is closed off in part by the dispensing front end wall 20 provided with the orifice 21.

The dispenser includes a fluid reservoir 3 containing a fluid in liquid or in powder form. In FIGS. 1 to 4, the fluid reservoir 3 is formed by a tube 31 engaged in the socket 25, closed off at one of its ends by an end wall 32 or by a stopper 32' and closed off in part at its other end by the dispensing front end wall 20 that is provided with the dispensing orifice 21. It is thus possible to say that the fluid reservoir is constituted mainly by the tube 31 closed off at its end wall and closed off by the dispensing front end wall 20 of the end-piece 2. In this example, the reservoir 3 is tubular in shape due to the shape of the tube 31, but naturally it is possible to imagine other shapes for the reservoir. However, it is advantageous for the reservoir 3 to be tubular in shape, at least so as to be fitted into the socket 25. In addition, the tubular shape of the reservoir 3 makes it possible to create a cylindrical annular space 16 inside the neck 15. It is generally advantageous for the reservoir 3 to extend inside the neck 15, preferably to inside the reservoir 10, as can be seen in the various FIGS. 1 to 4. The annular space 16 forms an annular constriction inside which the pressurized gas coming from the reservoir 10 is accelerated very considerably.

Figure 2:
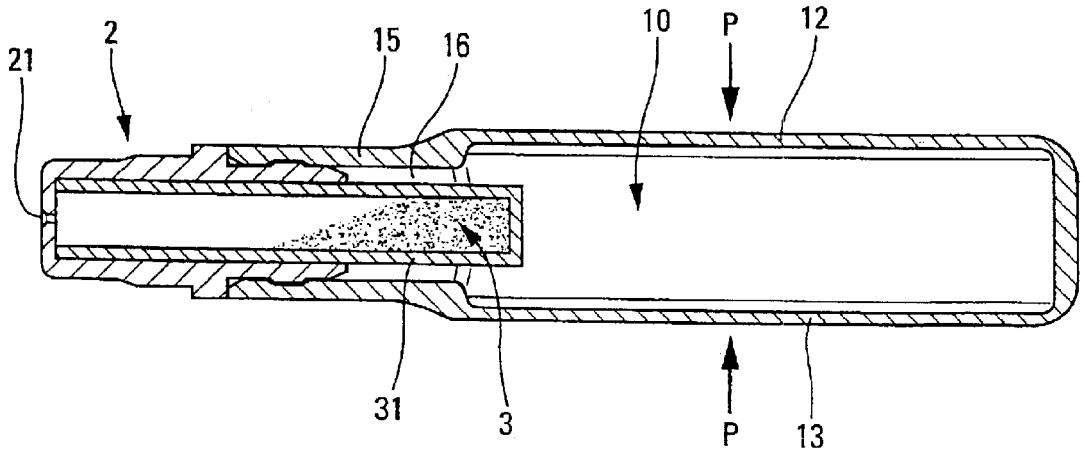
Figure 3:
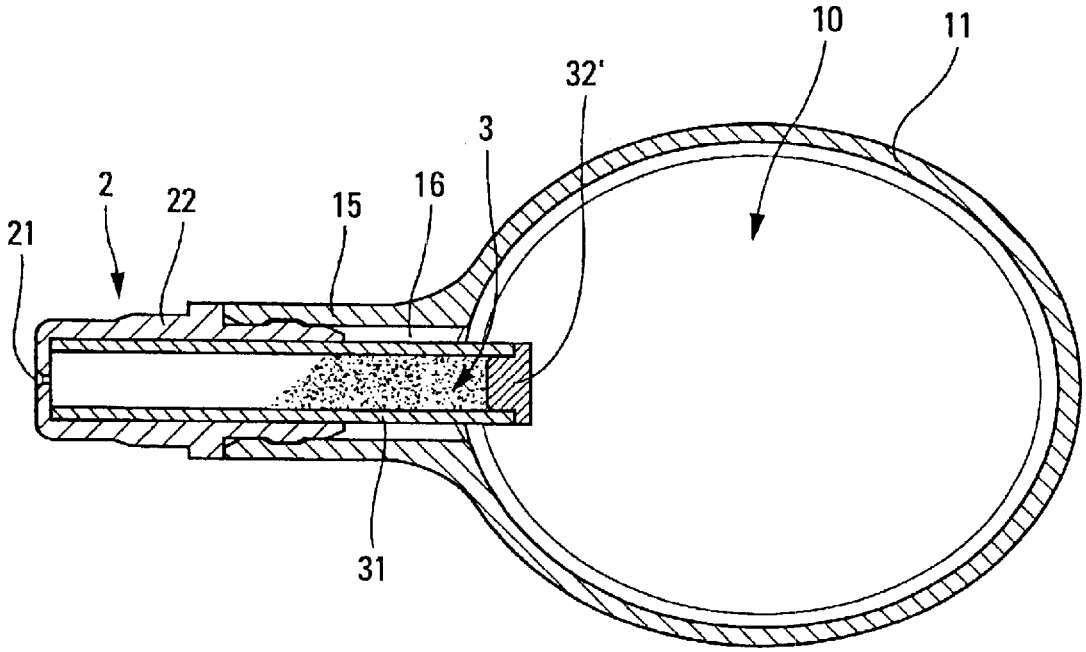
FIGS. 3 and 4 are views respectively similar to FIGS. 1 and 2 for a second embodiment of a fluid dispenser of the invention.
Figure 4:
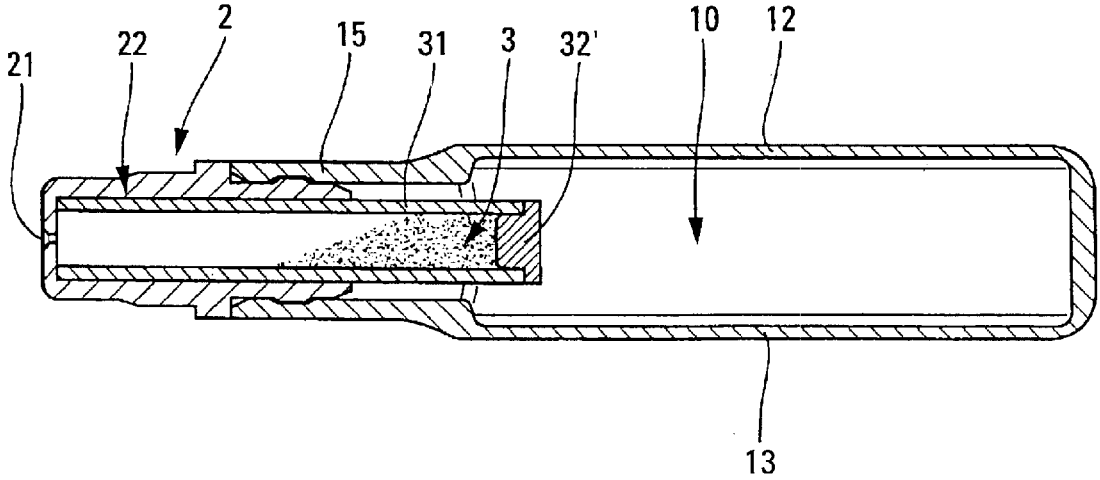

The end wall 32 shown in FIGS. 1 and 2 may be formed integrally with the tube 31 and of the same material as the material thereof. In the embodiment shown in FIGS. 3 and 4, a separate stopper 32' is mounted on the end of a tube 31 which then has no end wall of its own.

At its tube 31 and/or at its end wall 32, the reservoir 3 forms a partition that is permeable to the gas from the reservoir 10 and impermeable to the fluid contained in the reservoir 3. Thus, the fluid in liquid or in powder form stored inside the reservoir 3 cannot permeate into the reservoir 10 whereas the gas contained in the reservoir 10 can be driven through the porous or permeable partition of the reservoir 3 into the reservoir 3 so that it is then sprayed therefrom in two-phase manner. In the embodiment shown in FIGS. 1 and 2, the pressurized gas coming from the reservoir 10 can penetrate into the reservoir 3 at the tube 31 and also at the end wall 32. In the variant shown in FIGS. 3 and 4, the separate stopper 32' is entirely impermeable to gas so that the gas from the reservoir 10 is constrained to penetrate into the reservoir 3' via the partition 31 which is mostly and preferably totally disposed inside the neck 15. Thus, all of the pressurized gas if forced to go into the annular space 16 where it is accelerated considerably. In this way, the gas penetrates into the reservoir 3 at proper pressure or power.

Figure 5:
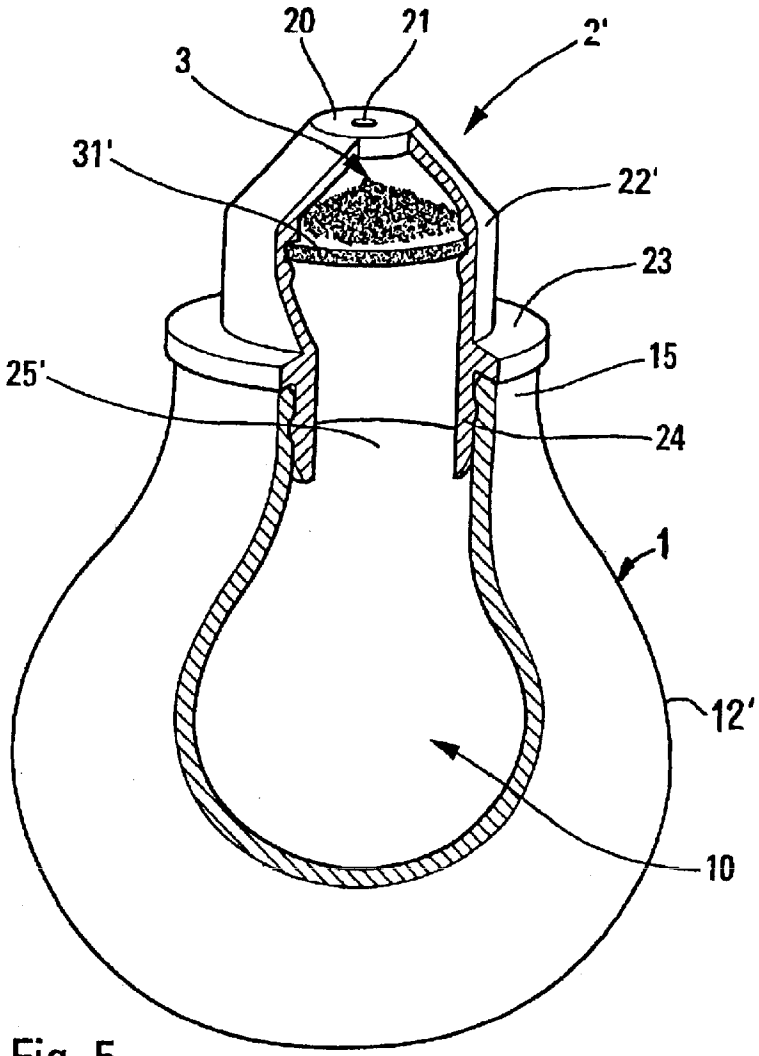
FIG. 5 is a view in cut-away perspective of a third embodiment of a dispenser of the invention.

FIG. 5 shows a dispenser having a receptacle 1 that is substantially in the form of a bulb that is deformable at its wall 12. This receptacle internally forms a gas reservoir 10. The receptacle forms a wide neck 15 which defines a large opening. An end-piece 2' whose overall design is analogous to the design used in the preceding embodiments is engaged in the neck 15 via its sleeve 24, and it rests on the neck via its collar 23. This end-piece 2' also forms a dispensing orifice 21 at its front wall 20. This wall 20 is connected to the collar 23 via a drum 22' that is frustoconical in part. The end-piece 2' forms an internal socket 25'. A partition 31' that is impermeable to the fluid (liquid or powder) and that is permeable to the gas is in engagement inside the socket, e.g. at a snap-fastening recess 220. This partition 31' subdivides the socket into two compartments, a first of which forms the fluid reservoir 3, and the second of which is part of the gas reservoir 10. This partition 31' thus forms a body which extends transversely in the socket 25', and which advantageously serves as a support for the fluid.

In this third embodiment, the end-piece forms an internal socket that is of relatively large diameter or cross-sectional area. The partition 31', which may advantageously be in the form merely of a porous plate, extends perpendicularly to the direction of the flow of pressurized gas. Thus, the gas goes more directly through the partition, and thus does not encounter much head loss or much resistance. The speed of the gas beyond the partition in the reservoir 3 is thus more than sufficient to entrain the fluid towards the orifice 21, assisted in this by the frustoconical shape of the drum 22', which directs and concentrates the two-phase flow towards the orifice.

The embodiments represented in FIGS. 1 to 5 do not integrate the spirit of the invention, which will be explained in reference to FIGS. 6 to 8. However, these embodiments comprise advantageous features able to be implemented with the invention.

Figure 6:
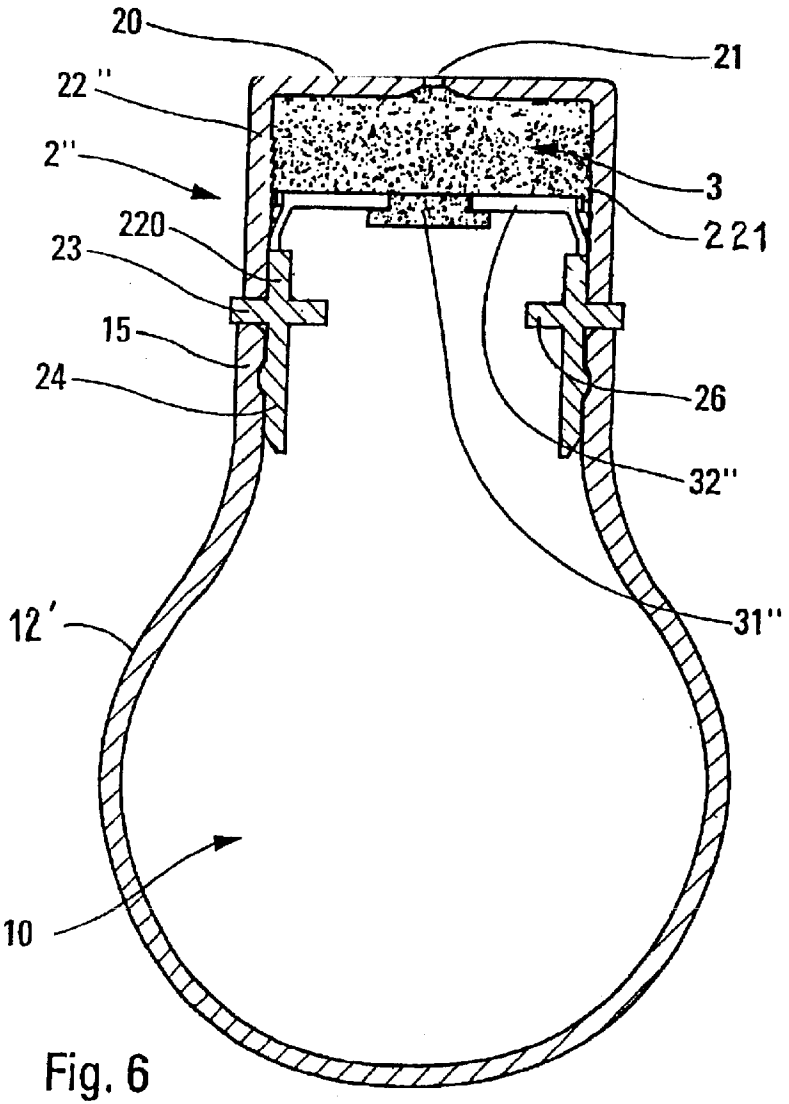
FIGS. 6, 7 and 8 are views in section respectively through fourth, fifth and sixth embodiments of a dispenser of the invention.
Figure 7:
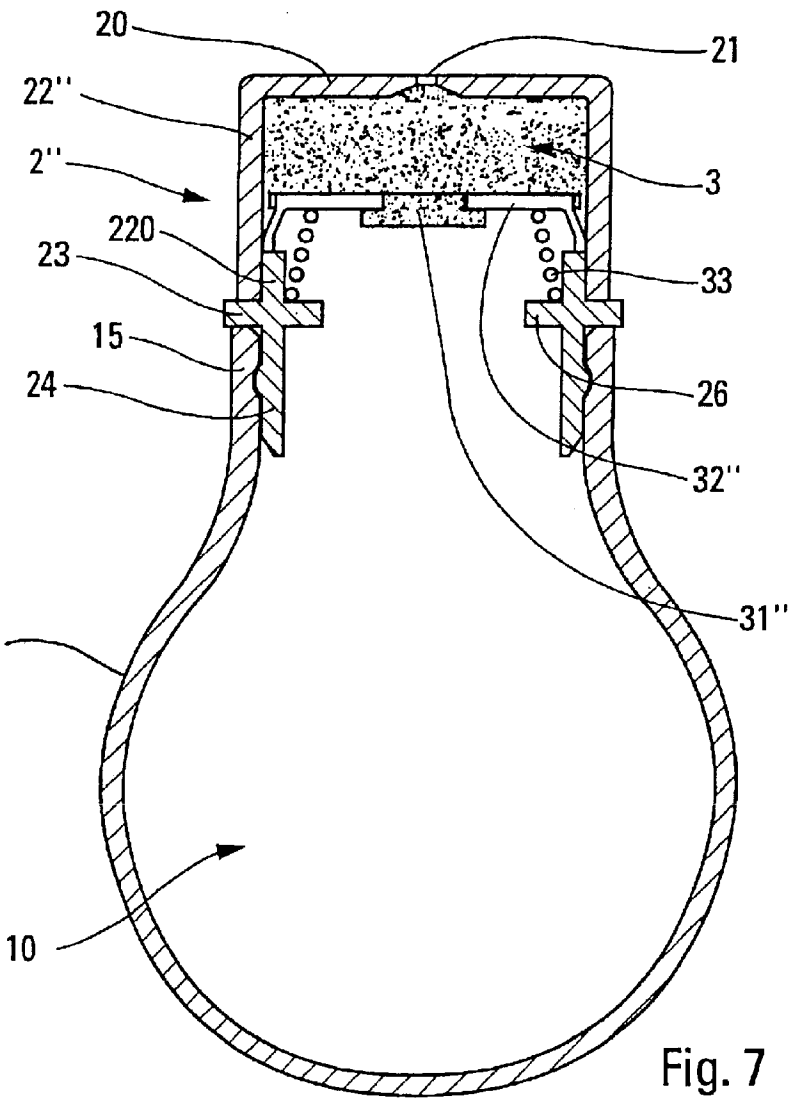

FIG. 7 shows a fourth embodiment of the invention. The receptacle forming the reservoir 10 may be of a design analogous to or identical to the designs of FIGS. 5 and 6, i.e. in the form of a squeezable bulb. This reservoir 10 also forms a neck 15 in which a dispensing end-piece 2" is engaged. This end-piece also forms a sleeve 24 engaged in the neck 15, a radial collar 23 which rests on the top end of the neck 15, a substantially cylindrical drum 22", a front end wall 20 and a dispensing orifice 21. In this example, the drum 22" and the front end wall 20 are separate from the remainder of the end-piece 22" formed by the sleeve 24 and the collar 23. However, it is possible to imagine a variant embodiment in which the end-piece 2" is made in one piece, as it is in the preceding embodiments. In this example, the drum 22" and the front end wall 20 are thus made in the form of a cup whose end-wall is provided with a through hole at the dispensing orifice 21. The cup is connected to the remainder of the end-piece 2" by the free end edge of the drum 22" being fitted around a fixing bushing 220 formed substantially in alignment with the sleeve 24. The edge of the drum comes into abutting contact against the radial collar 23.

In this embodiment, the dispensing end-piece 2" is further provided with an internal radial flange 26 which projects inwards. This radial flange 26 serves as an abutment member for a spring 33. The spring 33 serves to urge a follower piston or scraper piston 32"that is engaged inside the drum 22". The scraper-piston 32" may be made of a material that is permeable to the entraining gas and impermeable to the fluid. However, in the embodiment shown in FIG. 7, the scraper-piston 32' may also be impermeable to the entraining gas but serve as a support for a partition 31", which is permeable to the entraining gas and impermeable to the fluid. The entraining gas driven out of the reservoir 10 when said reservoir is squeezed is thus constrained to go through the partition 31" to reach the inside of the fluid reservoir 3. The fluid reservoir 3 is thus formed by the drum 22', by the front end-wall 20 provided with its through orifice 21, and by the scraper piston 32" which supports the partition 31". Since the scraper piston 32" is urged resiliently by the spring 33, the fluid inside the reservoir 3 is thus also urged towards the dispensing orifice 21. It is thus guaranteed that fluid is always present at the dispensing orifice 21, which is preferable in order to guarantee that dispensing beyond the orifice 21 is of good quality. In this example, the piston 32" with its partition 31" is moved towards the dispensing orifice 21. However, it is possible to imagine variant embodiments in which the piston acts in some other direction, e.g. a transverse direction, but while nevertheless ensuring that the dispensing orifice 21 is continuously fed with fluid. The object of the piston 32", and more generally of a moveable wall, is to guarantee that fluid is present at the dispensing orifice 21. Naturally, this may be achieved by other means.

Figure 8:
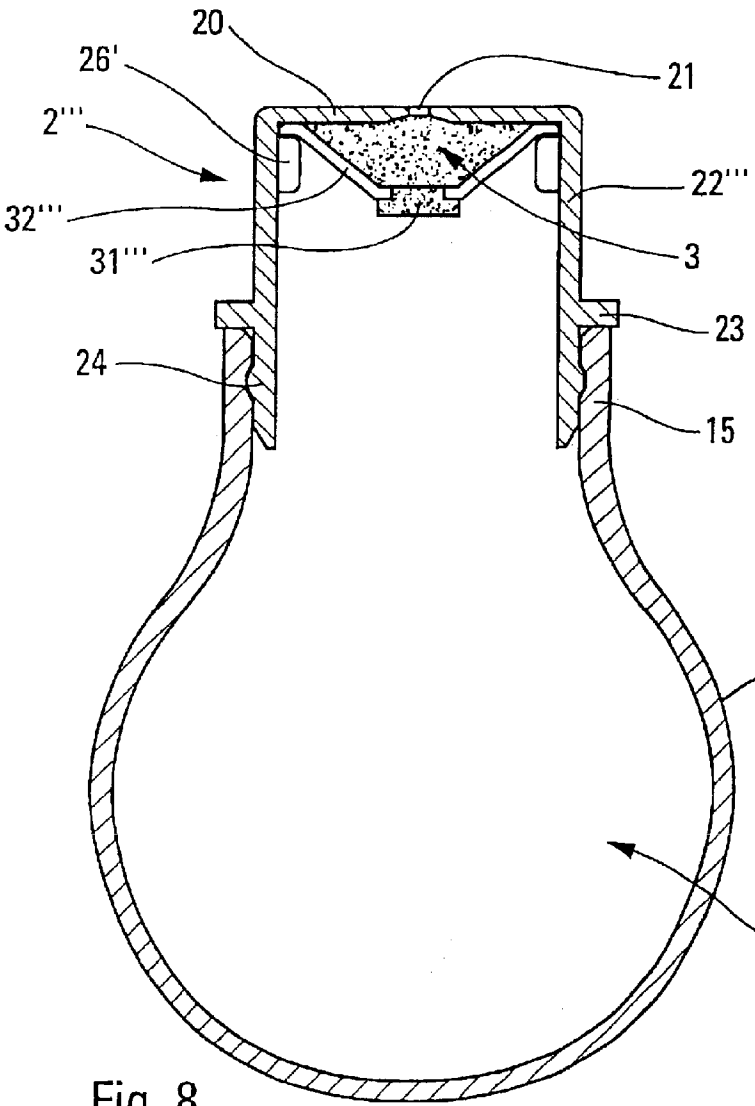

Reference is made finally to FIG. 8, which shows the fifth embodiment which is merely a variant of the embodiment shown in FIG. 7. The entraining gas reservoir 10 may be strictly identical, i.e. in the form of a bulb. A dispensing end-piece 2"' has a general configuration that is substantially identical to that of the end-piece 2" of FIG. 7. The end-piece 2"' comprises a sleeve 24 engaged in the neck 15 of the reservoir, a radial collar 23 in abutment against the top end of the neck 15, a drum 22"', and a front end wall 20 provided with a dispensing orifice 21. In this example, the dispensing end-piece 2"' is made in one piece.

As in the embodiment shown in FIG. 7, the fluid stored in the reservoir 3 is also urged towards the dispensing orifice 21 so as to guarantee a permanent continuous feed. In this example, to guarantee such a permanent continuous feed, an elastically-deformable membrane 32"' is provided that constitutes a moveable wall element of the fluid reservoir 3. This membrane 32"' is held around its periphery by means of a holding ring 26' engaged in the drum 22"'. More precisely, the outer peripheral edge of the membrane 32"' is wedged by the ring 26' against the front end wall 20. The membrane 32' may be made of a material that is permeable to the entraining gas and impermeable to the fluid, but preferably the membrane 32" serves as a support for a partition 31"' which may advantageously be positioned at its center. The membrane 32"' is initially pre-stressed so that it tends naturally to return to its rest position. The fluid inside the reservoir 3 is thus subjected to a pressure exerted by the membrane 32"'. The fluid 3 is thus continually urged towards the dispensing orifice 21. By looking at FIG. 8, it is easy to understand that the membrane 32"' tends to return to a position in which it is substantially pressed flat against the front end wall 20. It can be imagined that the membrane 32"' has a plane or flat configuration in its rest position.

In this sixth embodiment represented in FIG. 6, the dispenser has a configuration substantially identical to that of FIG. 7: the same numeral references have been used. The main difference with FIG. 7 is that the piston 32" carrying the permeable partition 31" is not biased by a spring. Initially, when the reservoir 3 is full, the piston may abut the bushing 220. Thereafter, as the reservoir gets empty, the piston is moved by the air flow under pressure which pushes the piston and passes through the partition. Advantageously, the inner wall 221 of the drum 22" may be formed with notches as a rack, thus preventing the piston from moving back. The pushing means of the movable wall of the fluid reservoir are here provided by the expelled air generated when the reservoir 10 is squeezed.

In the embodiments shown in FIGS. 6, 7 and 8, the permeable partition 31", 31"' is associated with means making it possible to urge the fluid inside the reservoir 3 towards and through the dispensing orifice 21. However, it is possible to imagine variant embodiments in which the permeable partition is not integral with, fixed to, or constituted by the means making it possible to deliver the fluid through the orifice 21. However, it is preferable for the partition to move towards the dispensing orifice 21 so that the distance travelled by the entraining gas inside the fluid reservoir 3 becomes shorter as the dispenser is used.

The material used for the partition that is permeable to the gas and impermeable to the fluid may have a porous structure, a grating structure, a screen structure, or a lattice structure depending on the fluid to be dispensed.

By means of the invention, it is possible to obtain a two-phase gas/liquid or gas/powder dispenser that is of very simple design, that is of very low cost, and that is easy to use.

What is claimed is:

1. A fluid dispenser comprising:

an entraining gas reservoir (10) provided with actuating means (12') suitable for pressurizing the gas contained in the reservoir;

a fluid reservoir (3); and a dispensing orifice (21) serving to pass a mixture made up of entraining gas and of fluid;

the fluid reservoir (3) being separated from the gas reservoir (10) by a partition (31"; 31"'), said partition being permeable to the gas and impermeable to the fluid, so that the pressurized gas penetrates into the fluid reservoir (3) through the partition, and entrains the fluid with it towards the dispensing orifice;

wherein the fluid is urged towards the dispensing orifice by thrust means (32"; 32"') so that fluid is always present at the dispensing orifice; and wherein the partition (31"; 31"') is mounted to move relative to and advantageously towards the dispensing orifice.

2. A fluid dispenser comprising:

an entraining gas reservoir (10) provided with actuating means (12') suitable for pressurizing the gas contained in the reservoir;

a fluid reservoir (3'); and a dispensing orifice (21) serving to pass a mixture made up of entraining gas and of fluid;

the fluid reservoir (3) being separated from the gas reservoir (10) by a partition (31"; 31"'), said partition being permeable to the gas and impermeable to the fluid, so that the pressurized gas penetrates into the fluid reservoir (3) through the partition, and entrains the fluid with it towards the dispensing orifice;

wherein the fluid is urged towards the dispensing orifice by thrust mean (32"; 32"') so that fluid is always present at the dispensing orifice;

wherein the fluid reservoir comprises a movable wall (31"; 31"') in a direction corresponding to a decreasing of the reservoir volume; and wherein the partition (31"; 31"') forms a part of the movable wall.

3. A dispenser according to claim 1, in which the partition (31"; 31"') is urged resiliently in the direction in which the internal volume of fluid reservoir decreases.

4. A fluid dispenser comprising:

an entraining gas reservoir (10) provided with actuating means (12') suitable for pressurizing the gas contained in the reservoir;

a fluid reservoir (3); and a dispensing orifice (21) serving to pass a mixture made up of entraining gas and of fluid;

the fluid reservoir (3) being separated from the as reservoir (10) by a partition (31"; 31"'), said partition being permeable to the gas and impermeable to the fluid, so that the pressurized gas penetrates into the fluid reservoir (3) through the partition, and entrains the fluid with it towards the dispensing orifice;

wherein the fluid is urged towards the dispensing orifice by thrust means (32"; 32"') so that fluid is always present at the dispensing orifice; and wherein the partition (31") is mounted on a scraper piston (32") which is slidably engaged in a cylinder (22").

5. A dispenser according to claim 1, in which the partition (31"') is mounted on a prestressed resilient membrane (32"') organized to return towards a rest position.

6. A dispenser according to claim 2, in which the wall is movable by the pressurized gas flow.

7. A dispenser according to claim 1, in which the partition of the fluid reservoir is situated in a constriction (16) formed by the entraining gas reservoir (1).

8. A dispenser according to claim 1, in which an end-piece (2; 2', 2", 2"') is in leaktight engagement with the neck (15) of the gas reservoir, said end-piece forming the dispensing orifice (21).

9. A fluid dispenser comprising:

an entraining gas reservoir (10) provided with actuating means (12') suitable for pressurizing the gas contained in the reservoir;

a fluid reservoir (3); and a dispensing orifice (21) serving to pass a mixture made up of entraining gas and of fluid;

the fluid reservoir (3) being separated from the gas reservoir (10) by a partition (31"; 31"'), said partition being permeable to the gas and impermeable to the fluid, so that the pressurized gas penetrates into the fluid reservoir (3) through the partition, and entrains the fluid with it towards the dispensing orifice;

wherein the fluid is urged towards the dispensing orifice by thrust mean (32"; 32"') so that fluid is always present at the dispensing orifice;

wherein the fluid reservoir comprises a movable wall (32"; 32"') in a direction corresponding to a decreasing of the reservoir volume; and wherein the wall is movable by the pressurized gas flow.

* * * * *